US010809001B2

(12) United States Patent
Gangitano

(10) Patent No.: US 10,809,001 B2
(45) Date of Patent: Oct. 20, 2020

(54) BLOW-DRY ENCLOSURE

(71) Applicant: Keith Gangitano, San Jose, CA (US)

(72) Inventor: Keith Gangitano, San Jose, CA (US)

( * ) Notice: Subject to any disclaimer, the term of this patent is extended or adjusted under 35 U.S.C. 154(b) by 168 days.

(21) Appl. No.: 16/106,055

(22) Filed: Aug. 21, 2018

(65) Prior Publication Data

US 2019/0310016 A1 Oct. 10, 2019

Related U.S. Application Data

(60) Provisional application No. 62/654,226, filed on Apr. 6, 2018.

(51) Int. Cl.

| | |
|---|---|
| ***F26B 3/02*** | (2006.01) |
| ***F26B 21/00*** | (2006.01) |
| ***F24F 13/02*** | (2006.01) |
| *F24F 3/16* | (2006.01) |
| *F24F 3/00* | (2006.01) |

(52) U.S. Cl.

CPC ..... *F26B 3/02* (2013.01); *F26B 21/001* (2013.01); *F24F 13/0218* (2013.01); *F24F 2003/008* (2013.01); *F24F 2003/1614* (2013.01); *Y10S 454/903* (2013.01)

(58) Field of Classification Search

CPC ..... F24F 1/0041; F24F 1/0038; F24F 1/0014; F24F 1/0018; F24F 1/0033; F24F 1/005; F24F 1/0071; F24F 1/0087; F24F 2003/008; F24F 3/14; F24F 3/16; F24F 3/1603; F24F 2003/1614; F24F 2009/002; F24F 13/0218; F24F 7/06; F24F 13/87; F24F 13/068; F26B 3/00; F26B 3/02; F26B 21/001; F26B 21/00; F26B 21/004; F26B 21/02; F26B 21/024; Y10S 454/903

See application file for complete search history.

(56) References Cited

U.S. PATENT DOCUMENTS

| | | | | | |
|---|---|---|---|---|---|
| 3,265,059 | A * | 8/1966 | Matthews | ..... | A61G 10/005 600/21 |
| 4,515,070 | A * | 5/1985 | Bobjer | ..... | F24F 7/065 454/200 |
| 4,732,592 | A * | 3/1988 | Spengler | ..... | F24F 3/161 55/356 |

(Continued)

FOREIGN PATENT DOCUMENTS

| | | | | | |
|---|---|---|---|---|---|
| EP | 3018426 | A1 * | 5/2016 | ..... | F24F 11/72 |
| GB | 2532434 | * | 5/2016 | | |

*Primary Examiner* — Christopher R Harmon
(74) *Attorney, Agent, or Firm* — André Henri Grouwstra

(57) ABSTRACT

A blow-dry enclosure has an inflatable bag made of rugged material, with on the front an opening to receive air from an air mover, and a vent or a vent carrier that can receive a vent. The inflatable bag may be in the shape of a block. The material may be coated with an impermeable layer, and it may be lightweight and machine-washable. The blow-dry enclosure may have two or more inflatable towers on the top, and an opening on the back to receive air. The vent may be removable, replaceable, and adjustable. The blow-dry enclosure may have a hose on the front opening to connect it to the air mover. It may further have connector flaps to connect it to other blow-dry enclosures, straps to allow it to curve forward or backward, or shorten it, and/or anchor tabs to tie it to the ground.

18 Claims, 18 Drawing Sheets

(56) References Cited

U.S. PATENT DOCUMENTS 5,004,483 A * 4/1991 Eller ..... B08B 15/026 134/111
5,044,259 A * 9/1991 Catan ..... F24F 7/065 454/305
5,090,972 A * 2/1992 Eller ..... B08B 15/026 134/111
5,230,723 A * 7/1993 Travis ..... A47L 5/38 55/323
5,314,377 A * 5/1994 Pelosi, III ..... F24F 3/161 454/187
6,048,264 A * 4/2000 Campbell ..... B60S 3/008 34/104
6,402,613 B1 * 6/2002 Teagle ..... F04D 19/002 454/195
7,707,840 B1 * 5/2010 Flores ..... A41D 13/0025 62/109
2003/0121240 A1 * 7/2003 Hung ..... B01D 46/0002 55/410
2004/0253919 A1 * 12/2004 Dube ..... A01K 1/0064 454/274
2006/0186225 A1 * 8/2006 Bartholmey ..... F24F 13/0209 239/499
2006/0252365 A1 * 11/2006 Gebke ..... F24F 13/0209 454/306
2011/0312263 A1 * 12/2011 Grandmaison ..... F24F 13/082 454/283
2012/0096802 A1 * 4/2012 Davenport ..... E04B 9/02 52/741.4
2014/0196880 A1 * 7/2014 Pinchuk ..... F24F 12/002 165/222
2014/0202540 A1 * 7/2014 Gebke ..... F16L 11/02 137/1
2017/0097163 A1 * 4/2017 Law ..... B01D 46/46
2018/0353044 A1 * 12/2018 Erkek ..... A47L 9/2805

* cited by examiner

BLOW-DRY ENCLOSURE

CROSS REFERENCES TO RELATED APPLICATIONS

This application claims priority from U.S. provisional patent application Ser. No. 62/654,226, entitled "Blow-Dry Enclosure" filed on Apr. 6, 2018, which is hereby incorporated by reference as if set forth in full in this application for all purposes.

TECHNICAL FIELD

The disclosed embodiments relate generally to tools and methods used in the water restoration industry, and in particular to those for controlling temperature, relative humidity, and air flow in an affected space, as well as controlling noise pollution and contamination of adjoining spaces.

BACKGROUND

Unless otherwise indicated herein, elements described in this section are not prior art to the claims and are not admitted being prior art by inclusion in this section.

It is very common for a water leak, large or small, in a structure built on a raised foundation, to find its way into a crawlspace. The crawlspace is a confined space that exists between the ground floor of a building and the earth that it rests upon, when the building is constructed with a raised foundation and not a slab of concrete foundation. This space can be very shallow, with sometimes only 10-12" between the structure and the earth. Usually it is in the order of 18-24", which is still very confined and very difficult for maneuvering workers, supplies and equipment. In the very common event that a crawlspace or another space or structure is affected by a water leak, it is critical to restore a dry and hygienic environment, which means removing the water from the structure and, often, the earth.

Drying crawlspaces can be difficult and time-consuming, hence costly. This is due to many factors including cold ambient temperatures, high relative humidity, the nature of the construction materials used in these spaces, hazards like electrical wires, plumbing, screws and nails sticking out of the structure, toxic gases, animals dead or alive, and possibly venomous, insects both dangerous and pestilent, and just the nature of the extremely confined space. Professionals in the water restoration industry struggle with all these issues while performing their duties.

The process of drying a structure, for example a crawlspace below a house after water damage has occurred, currently requires workers to make use of high-powered fans (air movers); portable dehumidifiers (dehu's) or desiccants, as well as in some cases improvised containment, or cordoning off of a space; or the introduction of additional heat. The process attempts to get moisture out of the building materials and into the air where the dehu or desiccants can remove it from the structure as quickly and efficiently as possible, thus restoring the building to a safe and hygienic dry standard.

The current procedures typically require that the equipment treat the volume of space included in all of, most of, or a large part of the affected structure, instead of limiting that space to the actual affected areas. Even when this space is "contained" or made smaller, professionals extensively use disposable plastic sheeting, such as sold by Visqueen. The contained space is often much larger than it has to be, and the process of building containment is time-consuming; it generates additional waste that must be disposed of and that may be polluting the environment; and the disposables increase the cost. Existing methods waste time, energy, and money. They are also noisy and contaminating.

SUMMARY

Water leaks in buildings create damage and unhealthy conditions. Professionals in the water restoration industry mitigate these by drying out affected structures. For various reasons, current methods are time and energy consuming, and costly. They are also noisy and polluting the environment. Embodiments of the invention address these problems.

In a first aspect, an embodiment provides a blow-dry enclosure including an inflatable bag made of rugged material. The inflatable bag may be in the shape of a block. On the front it has an opening to receive air from an air mover, and one or more vents. The material may be coated with an impermeable layer, for example on the inside, and it may be lightweight and machine-washable. The blow-dry enclosure may have two or more inflatable towers on the top. These increase the surface area and allow the blow-dry enclosure to more easily wrap around features on the ceiling of a crawlspace, leaving smaller gaps. It may also have an opening on the back to receive air from a heat injector. The vents may be removable, replaceable, and adjustable. This allows for adjusting the direction and angle of air blowing out of the vents. The blow-dry enclosure may have a hose on the front opening to connect it to the air mover, and it may have a hose at the back opening to connect it to the heat injector, or in some case to another air mover. It may further have connector flaps to connect it to other blow-dry enclosures, straps to allow it to curve forward or backward or to shorten it, and/or anchor tabs to tie it to the ground.

In a second aspect, an embodiment provides a method of drying a section of a space (such as a crawlspace). The method comprises the following steps: (a1) Placing an inflatable bag between the first section and a second section (that doesn't need to be dried) of the space. (a2) Optionally—heating air from the second section. (a3) Optionally—injecting the heated air into the inflatable bag to inflate it. (b) Releasing air from the inflatable bag into the first section to provide an air flow in the first section, while keeping the inflatable bag inflated. (c) Using a dehumidifier or desiccants to extract moisture from the flowing warm air in the first section. (d) Moving warm air from the first section into the inflatable bag to keep it inflated. Lastly, (e) Repeating steps (b)-(d) until the first section has reached an industry dry standard.

A further understanding of the nature and the advantages of particular embodiments disclosed herein may be realized by reference of the remaining portions of the specification and the attached drawings.

BRIEF DESCRIPTION OF THE DRAWINGS

The invention will be described with reference to the drawings, in which.

DETAILED DESCRIPTION

Water leaks in buildings create damage and unhealthy conditions. Professionals in the water restoration industry mitigate these by drying out affected structures. For various reasons, current methods are time and energy consuming, and costly. They are also noisy and polluting the environment. Embodiments of the invention address these problems.

Figure 1:
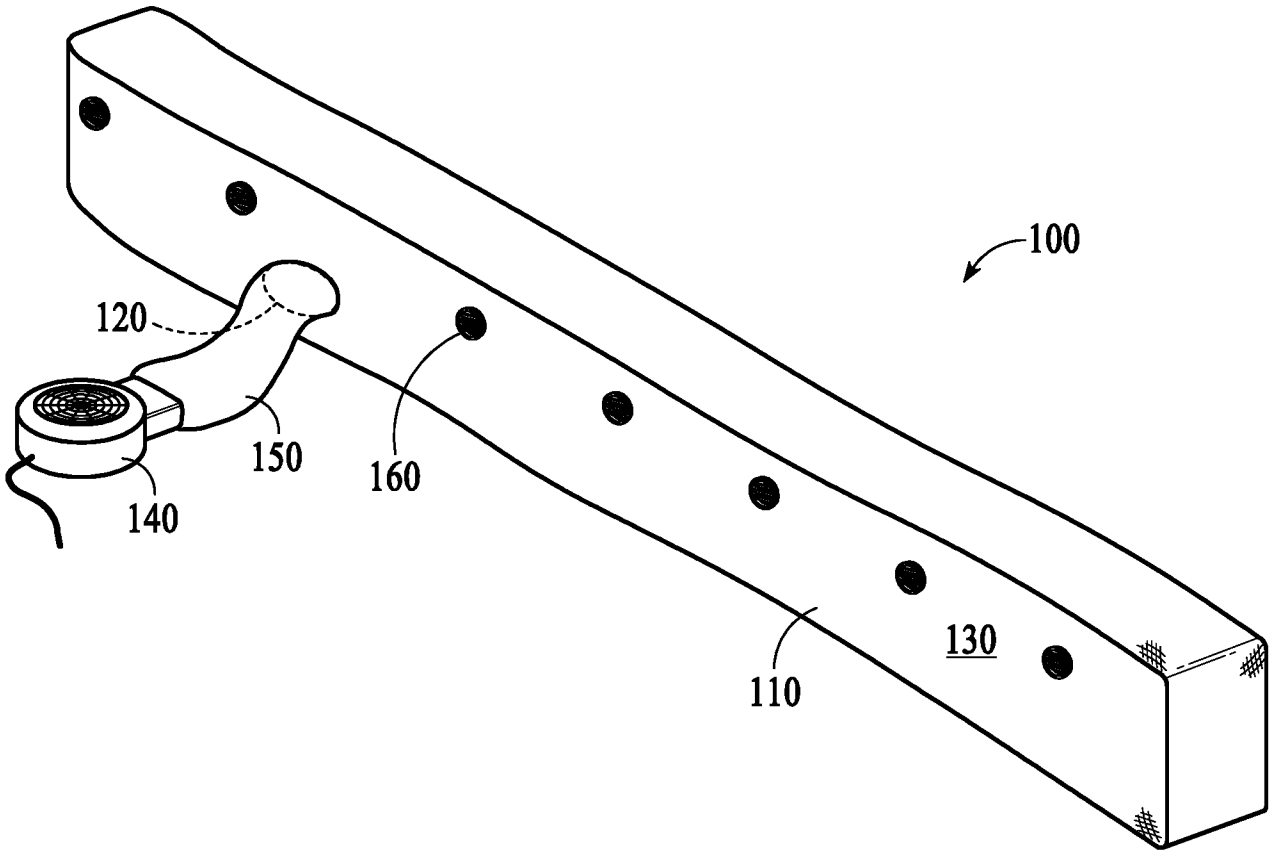
FIG. 1 illustrates a blow-dry enclosure according to an embodiment of the invention.

FIG. 1 illustrates a blow-dry enclosure 100 according to an embodiment of the invention. Blow-dry enclosure 100 comprises an inflatable bag 110 with a first opening 120 located on a first side 130. Inflatable bag 110 may generally be in the shape of a block, or any other shape that is suited for separating parts of a space between a ceiling and a ground. Inflatable bag 110 is made of a rugged material, that withstands puncturing. In some embodiments, the material is fire-rated. In further embodiments, the material is coated on the inside with an impermeable layer to reduce air leakage. In yet further embodiments, the material is lightweight and machine-washable.

First opening 120 is configured to receive air inflow from a first air mover 140. In some embodiments, first air mover 140 is connected to first opening 120 via a hose 150.

Inflatable bag 110 further comprises one or more vents 160 on first side 130. In some embodiments, a vent may be removable and replaceable.

Figure 2:
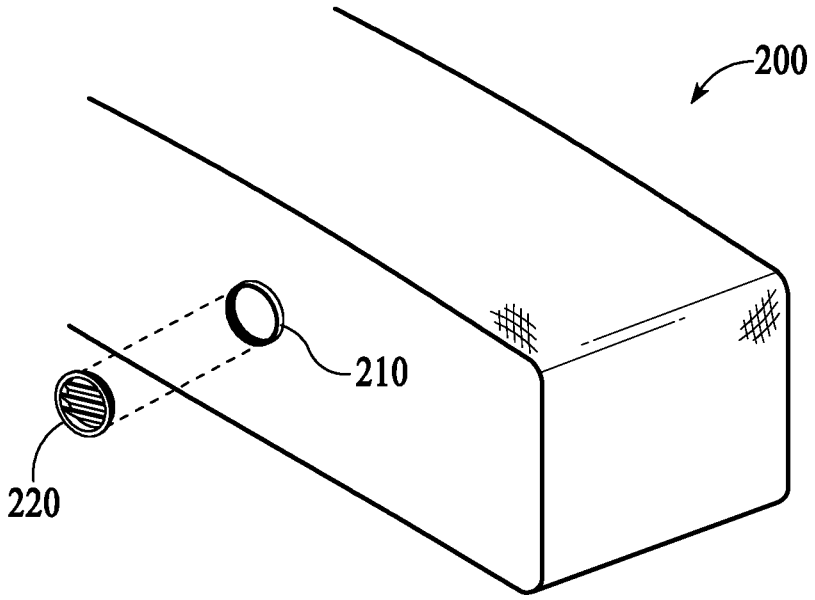
FIG. 2 illustrates a vent and a vent carrier according to an embodiment of the invention.

FIG. 2 illustrates a vent 220 and a vent carrier 210 according to an embodiment of the invention. In this embodiment, blow-dry enclosure 200 comprises vent 220 that is removable and replaceable. Vents may be configured to let out air in a preferred direction, for example in an angle of 15, 30, or 45 degrees. Vents may be color coded (or otherwise coded) to indicate the air angle. For instance, vents could have a number of vanes that indicate the angle, for example 5 vanes for 15 degrees, 4 vanes for 30 degrees, and 3 vanes for 45 degrees. A user may remove vent 220 from vent carrier 210, and if required, replace it with a different vent, for example to change the angle of air flow.

Figure 3:
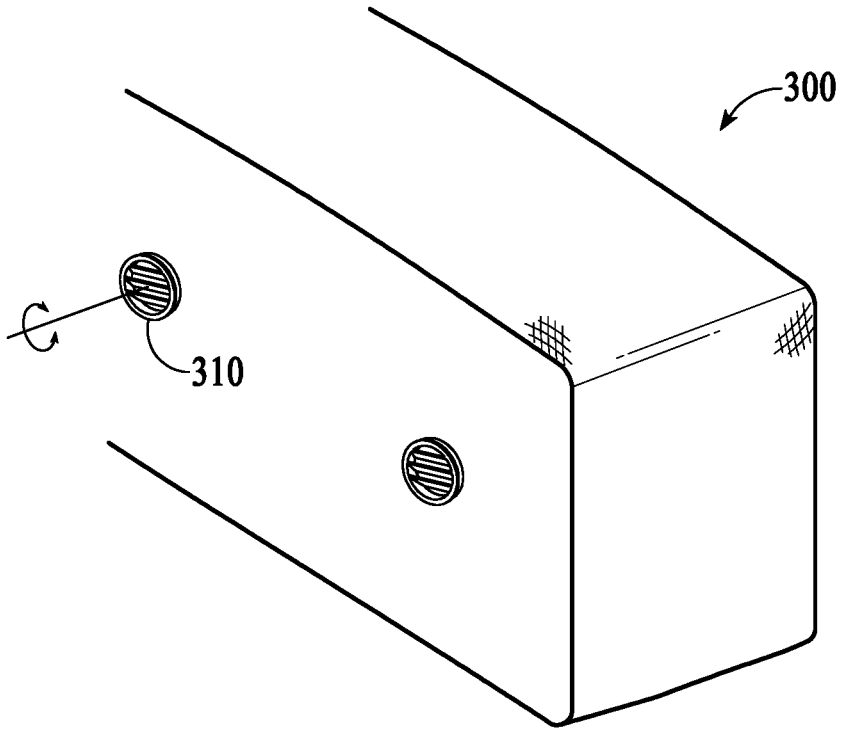
FIG. 3 illustrates a blow-dry enclosure with a vent that can be rotated, according to an embodiment of the invention.

FIG. 3. illustrates a blow-dry enclosure 300 with a vent 310 that can be rotated, according to an embodiment of the invention. Vent 310 is mounted in a vent carrier (not visible) that allows vent 310 to be rotated. By rotating vent 310, a user can adjust the air direction. If the air already comes out in an angle, it can be adjusted to blow up, down, sideways, or in any other required angle.

Figure 4:
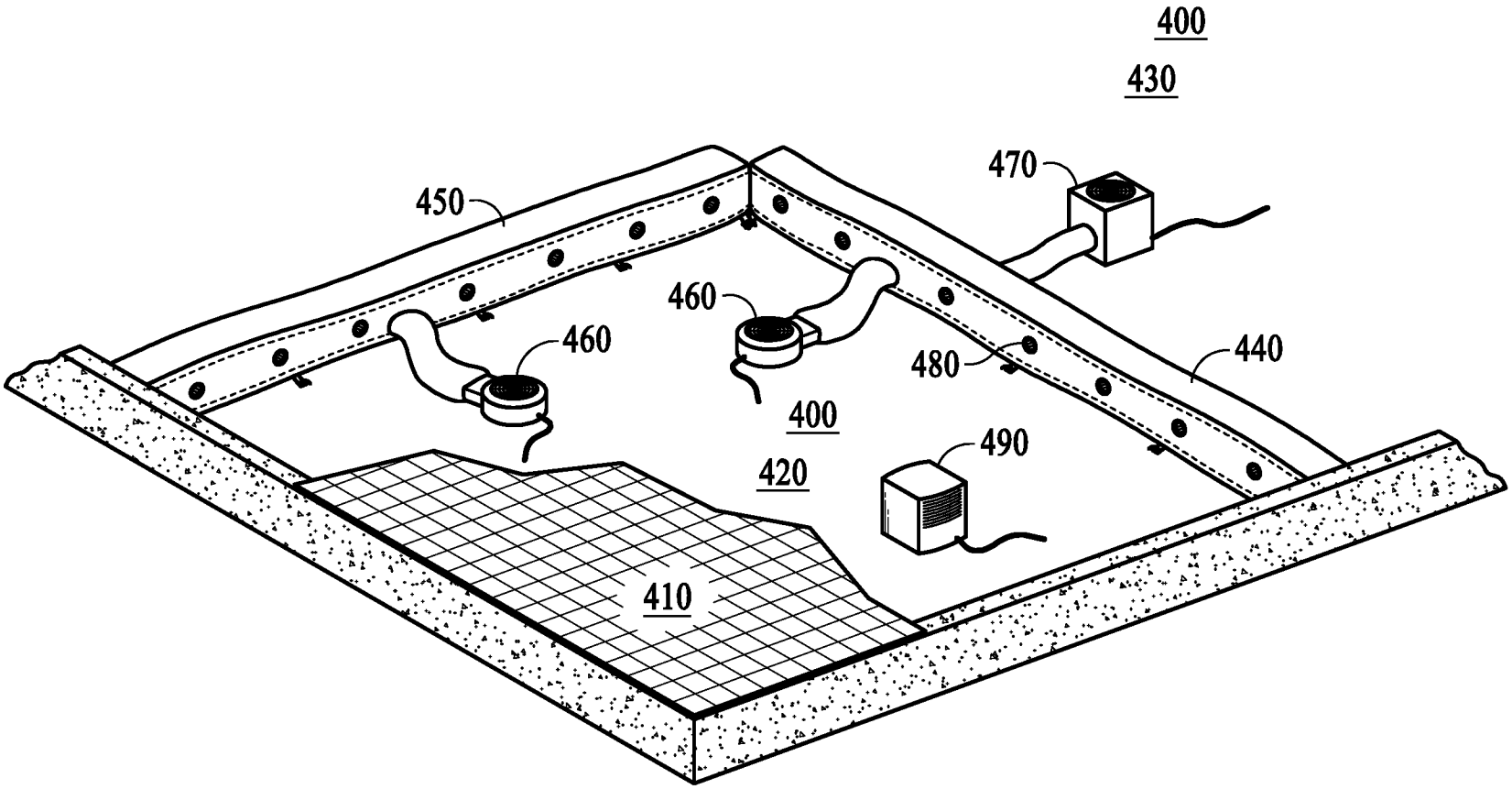
FIG. 4 illustrates an example of using embodiments of the invention in a crawlspace.

FIG. 4 illustrates an example of using embodiments of the invention in a crawlspace 400. Crawlspace 400 is located below a floor 410 and is partitioned in first section 420 which needs to be dried, and second section 430 which does not need to be dried. Crawlspace 400 has one or more dehumidifiers 490 (dehu's), located in first section 420. A first blow-dry enclosure 440 and a second blow-dry enclosure 450 separate first section 420 from second section 430. Each first blow-dry enclosure 440 and second blow-dry enclosure 450 are connected with an air mover 460, and first blow-dry enclosure 440 is additionally connected with a heat injector 470.

Heat injector 470 takes in air from second section 430 and heats the air before injecting it into first blow-dry enclosure 440. The hot air inflates first blow-dry enclosure 440, so that it becomes a wall in crawlspace 400 from its bottom to the underside of floor 410. The hot air also escapes first blow-dry enclosure 440 via vents 480, blowing into first section 420, which it dries out as a result of its temperature, humidity, and speed. The air mover 460 connected with first blow-dry enclosure 440 recycles air from first section 420 into first blow-dry enclosure 440, so that it stays sufficiently inflated. As is apparent from FIG. 4, second blow-dry enclosure 450 may function well without a heat injector. Air injected from first section 420 by its air mover 460 keeps second blow-dry enclosure 450 sufficiently inflated. The one or more dehumidifiers 490 further heat and remove moisture from the recycling air.

Figure 5:
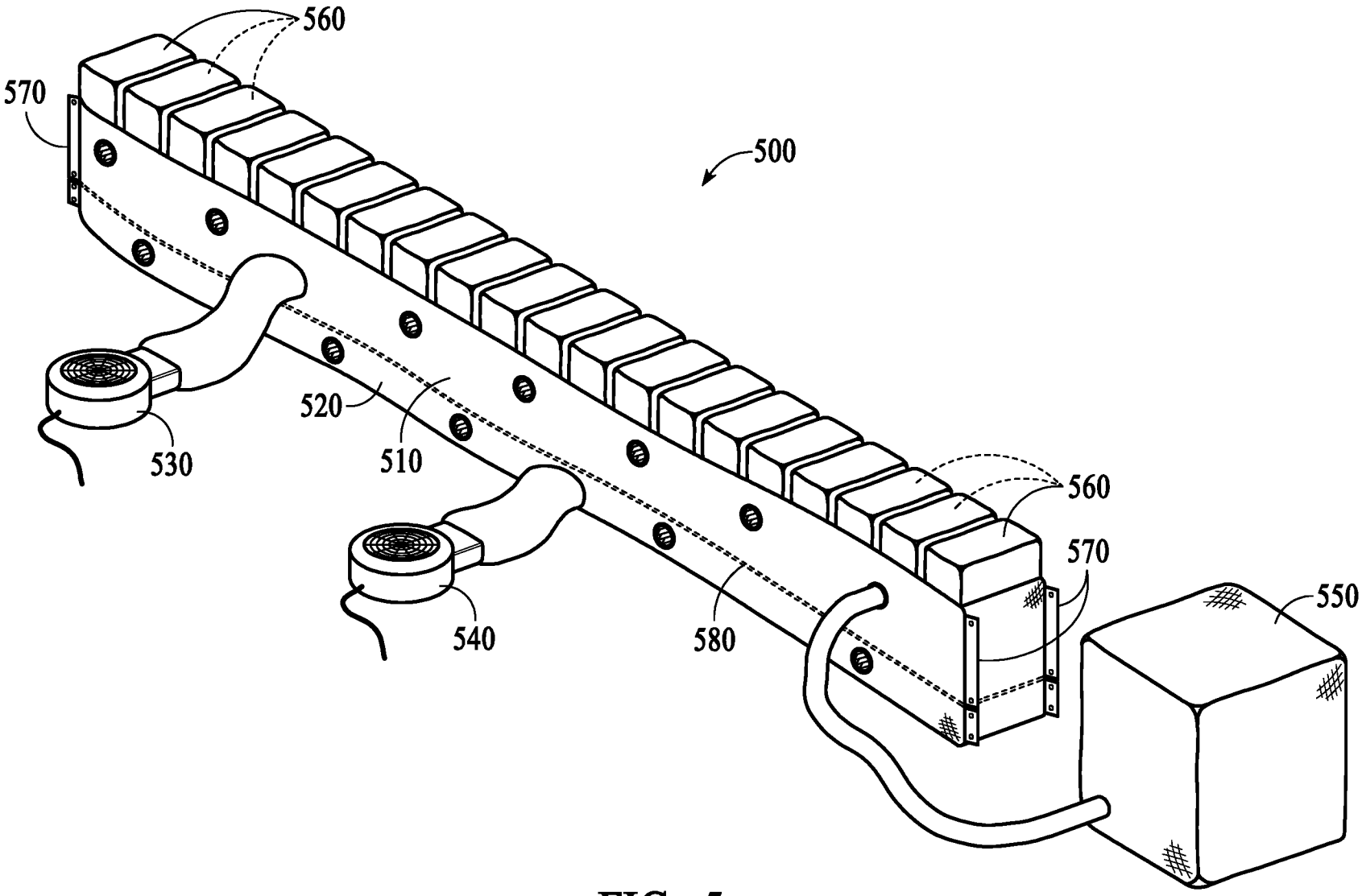
FIG. 5 illustrates a combination of two embodiments of the invention.

FIG. 5 illustrates a combination 500 of two embodiments of the invention. Combination 500 includes first blow-dry enclosure 510 mounted on top of second blow-dry enclosure 520. First blow-dry enclosure 510 is connected with first air mover 530, and second blow-dry enclosure 520 is connected with second air mover 540. First blow-dry enclosure 510 is additionally connected, via one of its vents, with air block 550. First blow-dry enclosure 510 further features towers 560 at its top, and connector flaps 570 at its corners.

First blow-dry enclosure 510 and second blow-dry enclosure 520 are vertically connected via connectors 580, which provide the capability to do so without creating a horizontal air gap. By stacking two or more blow-dry enclosures, potentially of different standard heights, it is possible to build a combined blow-dry enclosure of any height that may be required. As was shown in FIG. 4, it may also be required to combine two or more blow-dry enclosures horizontally.

Connector flaps 570 provide the capability to do so without creating a vertical air gap. Embodiments may provide connectors in any direction, including vertical and horizontal connectors in an x/y/z coordinate system, as well as in any other angles to such coordinate system. Connectors may or may not include a flap. In some embodiments, connectors may further include a snap, a hook-and-loop fastener (for example, such as provided by Velcro), a zipper, a tie, a hook, a loop or ring, or any other connection mechanism known in the art.

Figure 6:
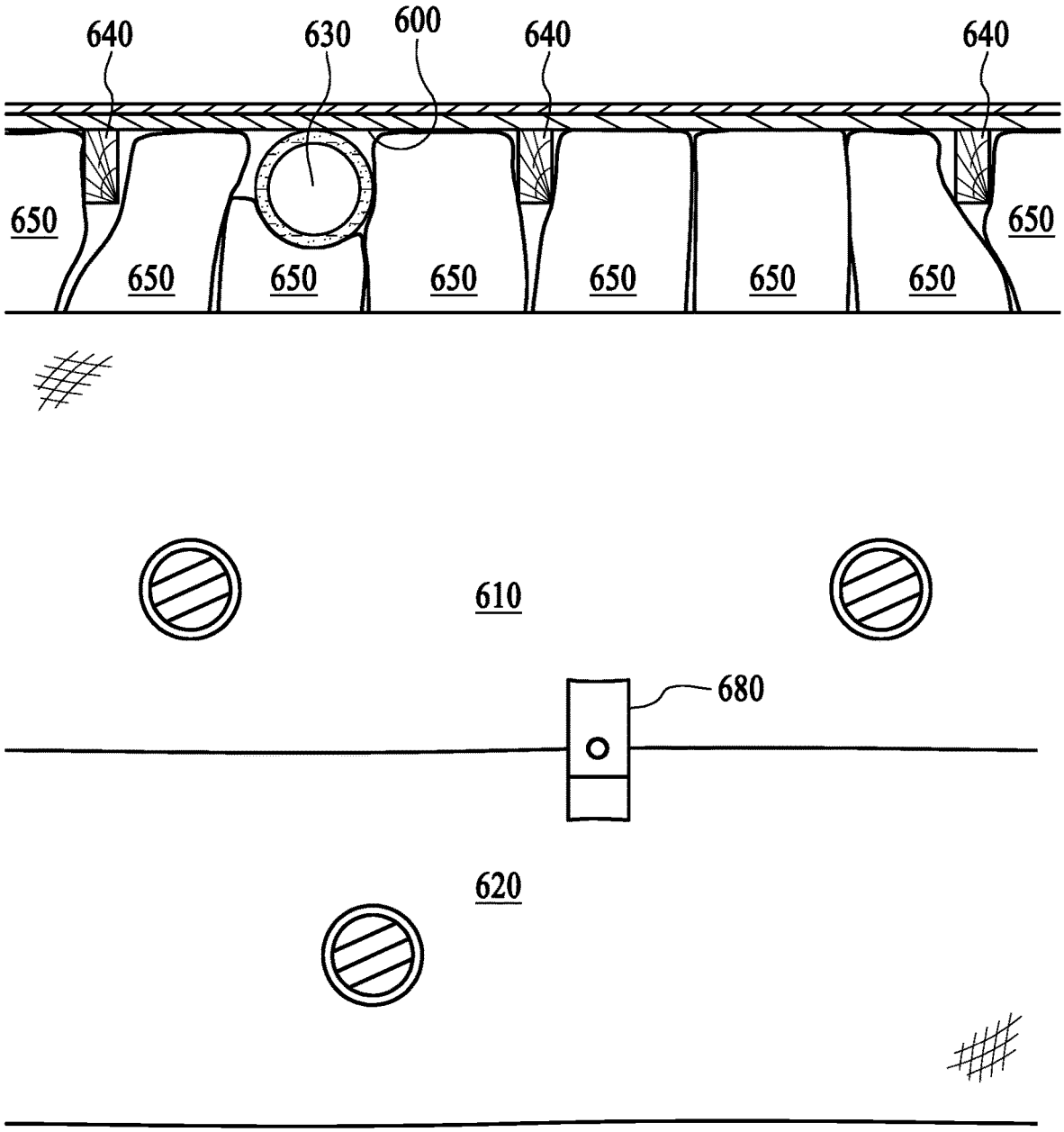
FIG. 6 illustrates how towers, according to an embodiment of the invention, can minimize air gaps right below a ceiling.

The towers 560 at the top of first blow-dry enclosure 510 allow filling up the height of a crawlspace while leaving minimal gaps due to features at the bottom of the crawlspace ceiling, as will be shown with respect to FIG. 6. Although FIG. 5 shows towers 560 for clarity drawn at a little distance from each other, in embodiments towers 560 may be directly adjacent to each other.

The air block 550 provides an optional extension to first blow-dry enclosure 510 and/or second blow-dry enclosure 520. A user may use a vent for connecting a hose to inflate air block 550. Air leaving first blow-dry enclosure 510 enters and inflates air block 550 to fill up gaps and/or irregularities of a crawlspace.

FIG. 6 illustrates how towers 650, according to an embodiment of the invention, can minimize air gaps right below a ceiling 600. A first blow-dry enclosure 610 is mounted on top of a second blow-dry enclosure 620 using connector 680. Ceiling 600 has features such as sewer pipe 630 and support beams 640. By providing extra surface area, towers 650 can more accurately follow the profile at the bottom of ceiling 600, thereby minimizing air gaps around those ceiling features.

Embodiments may provide towers in a variety of shapes, including single blocks lined up along the length of a blow-dry enclosure as shown in the figures, or as extensions with other shapes such as cylinders, puckers, balls, multiple blocks, and any other shapes that provide additional surface area.

Figure 7:
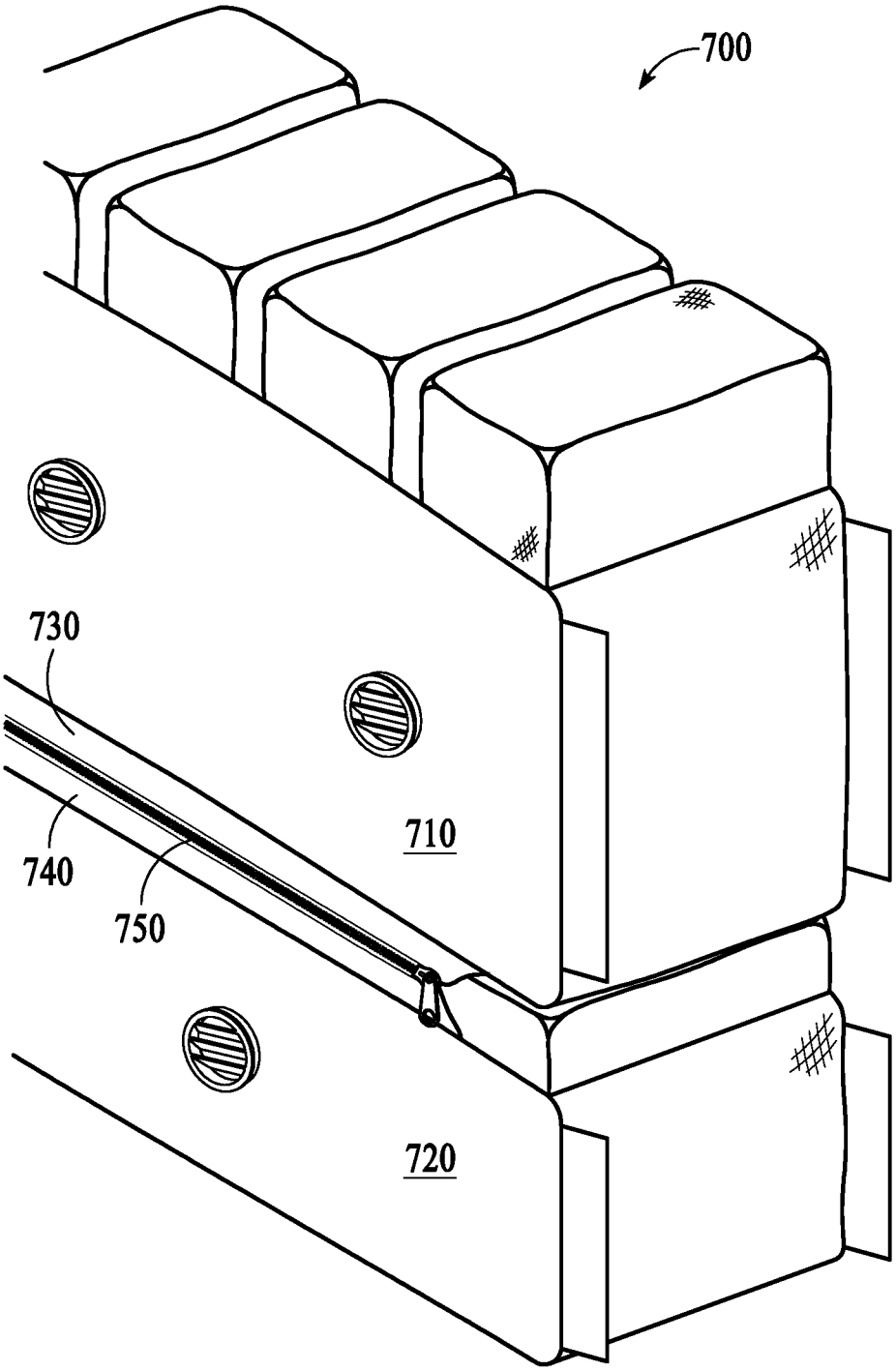
FIG. 7 illustrates a combination of two blow-dry enclosures with zipper connectors according to an embodiment of the invention.

FIG. 7 illustrates a combination 700 of two blow-dry enclosures with zipper connectors according to an embodiment of the invention. Combination 700 includes first blow-dry enclosure 710 and second blow-dry enclosure 720. First blow-dry enclosure 710 has a first connector flap 730, and second blow-dry enclosure 720 has a second connector flap 740. First connector flap 730 and second connector flap 740 each include part of zipper 750. Zipper 750 provides a fast and convenient way to connect first connector flap 730 and second connector flap 740, and thereby to connect first blow-dry enclosure 710 and second blow-dry enclosure 720.

Figure 8:
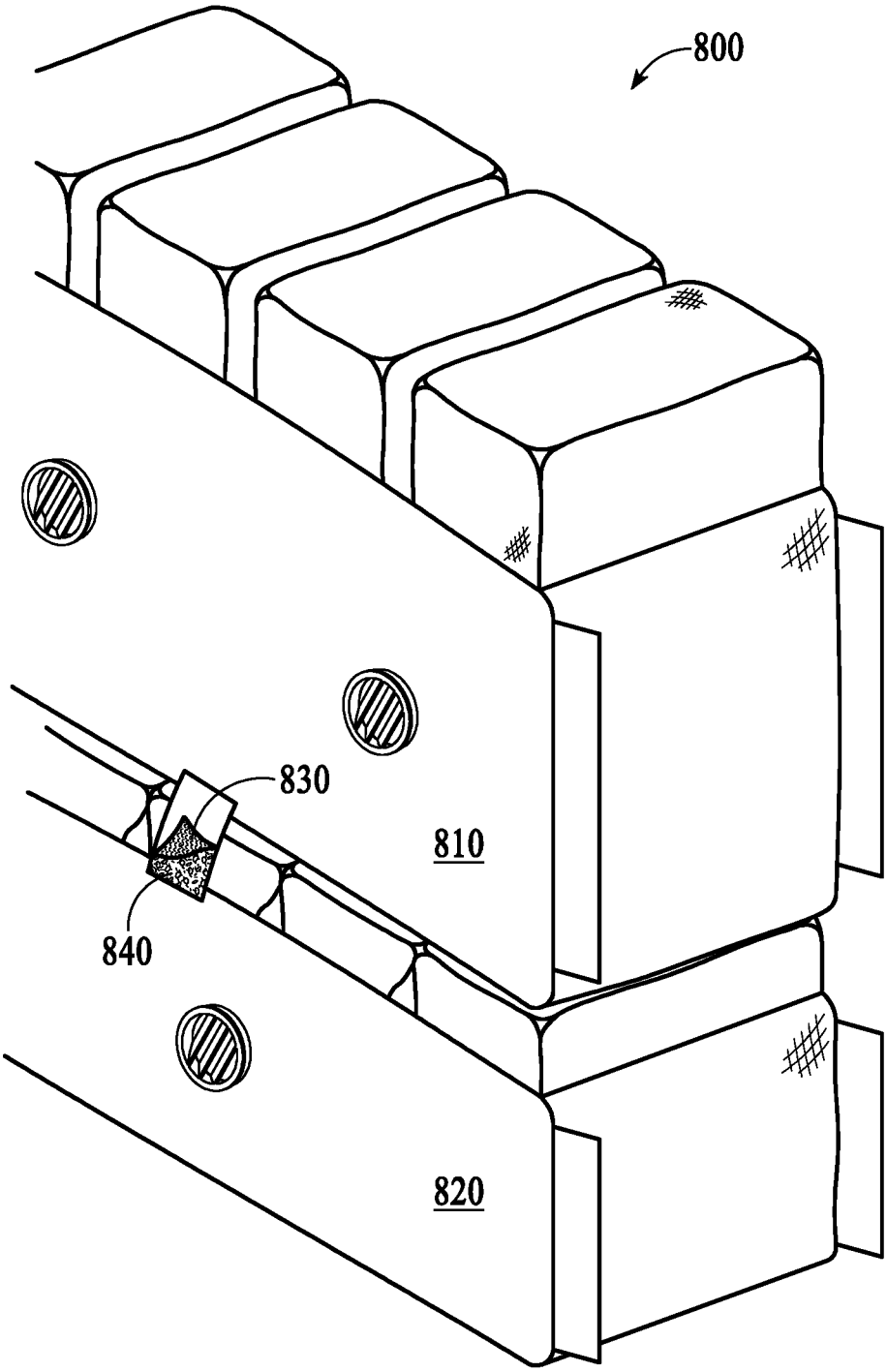
FIG. 8 illustrates a combination of two blow-dry enclosures with hook-and-loop fastener connectors according to an embodiment of the invention.

FIG. 8 illustrates a combination 800 of two blow-dry enclosures with hook-and-loop fastener connectors according an embodiment of the invention. Combination 800 includes first blow-dry enclosure 810 and second blow-dry enclosure 820. First blow-dry enclosure 810 has a first connector flap 830 and second blow-dry enclosure 820 has a second connector flap 840. First connector flap 830 and second connector flap 840 each include part of a hook-and-loop fastener, such that first blow-dry enclosure 810 and second blow-dry enclosure 820 can be connected to each other fast and conveniently.

Figure 9:
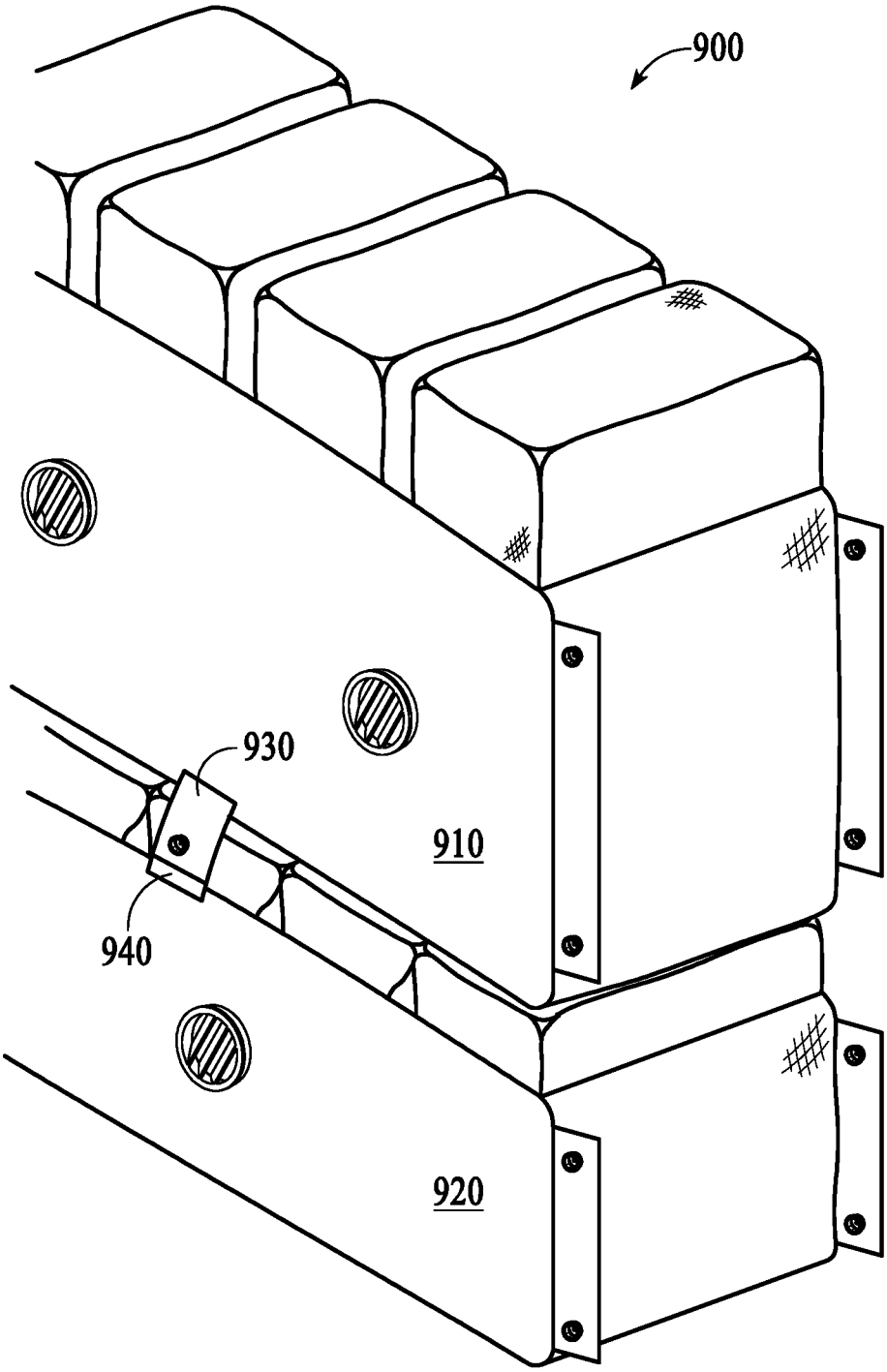
FIG. 9 illustrates a combination of two blow-dry enclosures with snap connectors according to an embodiment of the invention.

FIG. 9 illustrates a combination 900 of two blow-dry enclosures with snap connectors according to an embodiment of the invention. Combination 900 includes first blow-dry enclosure 910 and second blow-dry enclosure 920. First blow-dry enclosure 910 has a first connector flap 930 and second blow-dry enclosure 920 has a second connector flap 940. First connector flap 930 and second connector flap 940 each include part of a complementary pair of snaps, such that first blow-dry enclosure 910 and second blow-dry enclosure 920 can be connected to each other fast and conveniently.

Figure 10:
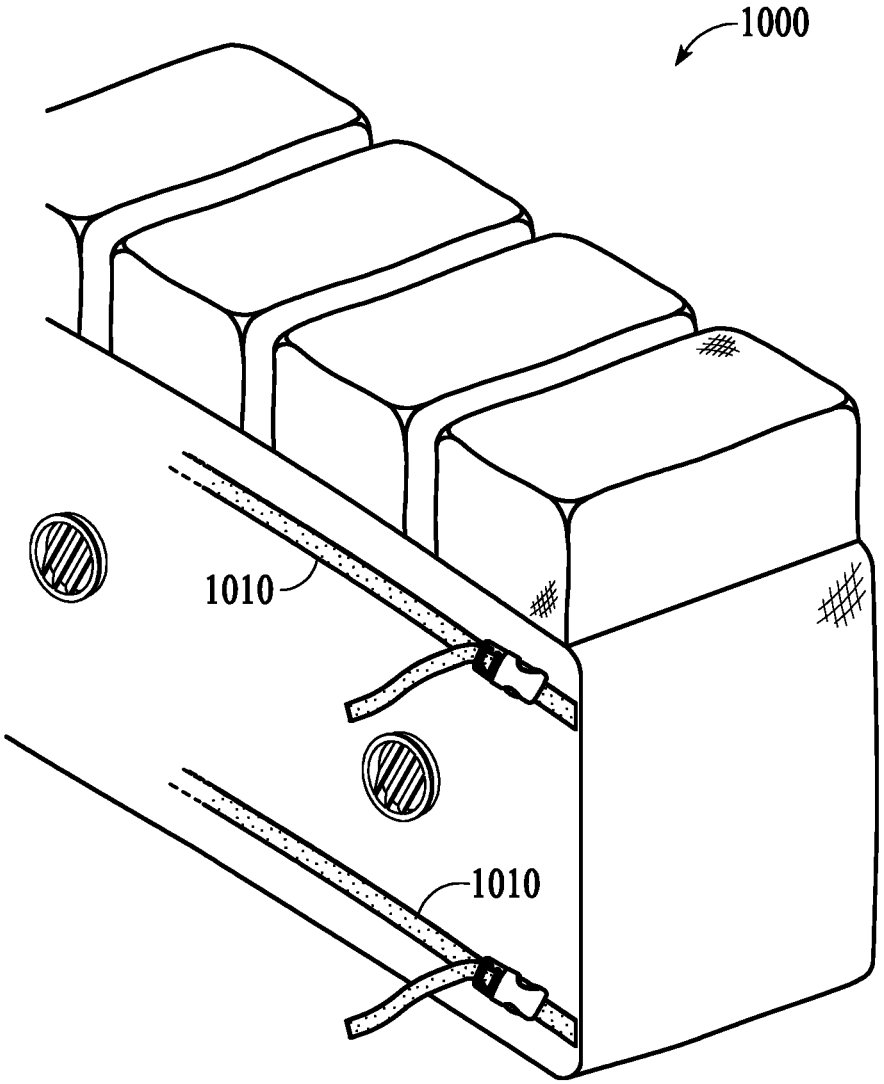
FIG. 10 illustrates a blow-dry enclosure with straps according to an embodiment of the invention.

FIG. 10 illustrates a blow-dry enclosure 1000 with straps 1010 according to an embodiment of the invention. Straps 1010 may be positioned at the front or back, or both, of blow-dry enclosure 1000. The lengths of straps 1010 are adjustable, which allows for curving and/or shortening blow-dry enclosure 1000. Straps 1010 on the front of blow-dry enclosure 1000 allow for curving forward, and straps (not shown) on the back of blow-dry enclosure 1000 allow for curving backward. In some embodiments, straps 1010 are removable. An embodiment with straps 1010 both on the front and the back allows for shortening blow-dry enclosure 1000.

Figure 11:
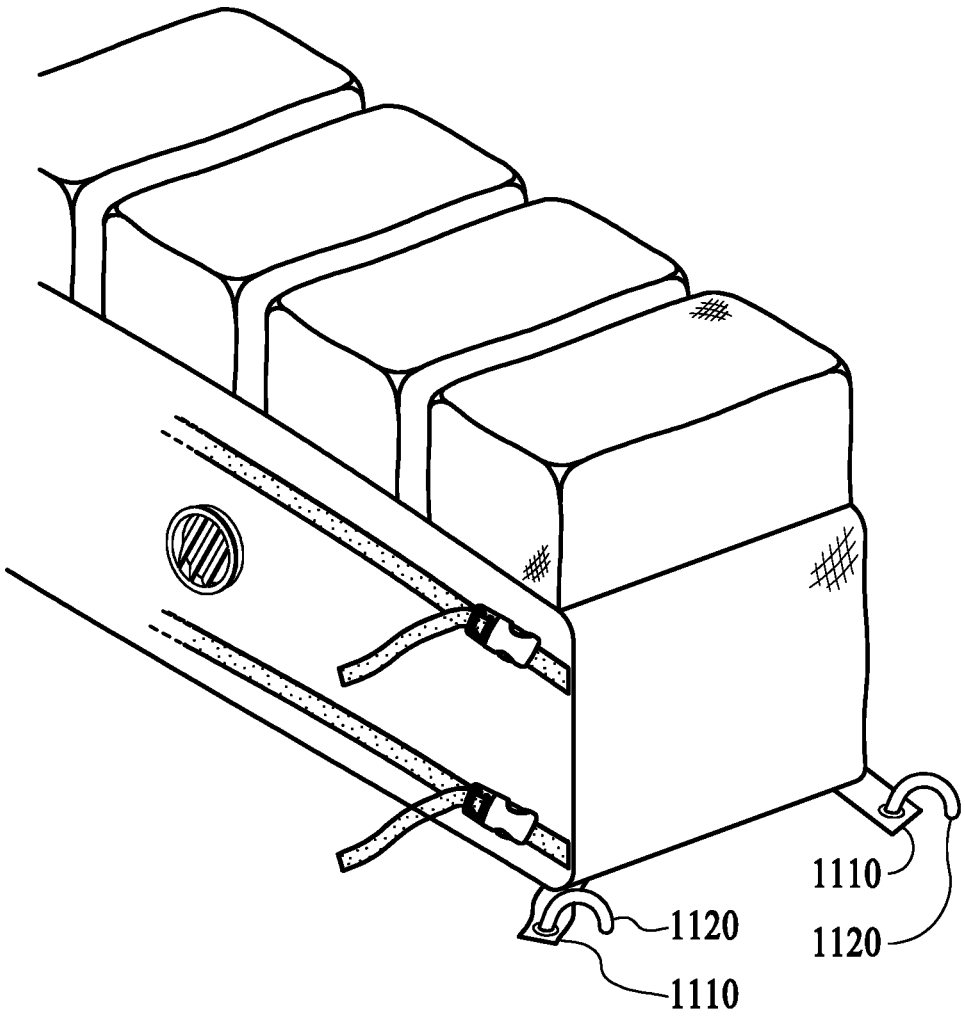
FIG. 11 illustrates a blow-dry enclosure with anchor tabs according to an embodiment of the invention.

FIG. 11 illustrates a blow-dry enclosure 1100 with anchor tabs 1110 according to an embodiment of the invention. The embodiment may provide anchor tabs 1110 at one or more corners. An anchor tab may include a grommet through which a user can insert an anchor 1120 to fasten blow-dry enclosure 1100 to a crawlspace ground, or generally, an anchor tab may include any provisions known in the art that allow fastening blow-dry enclosure 1100 to the crawlspace ground.

Figure 12:
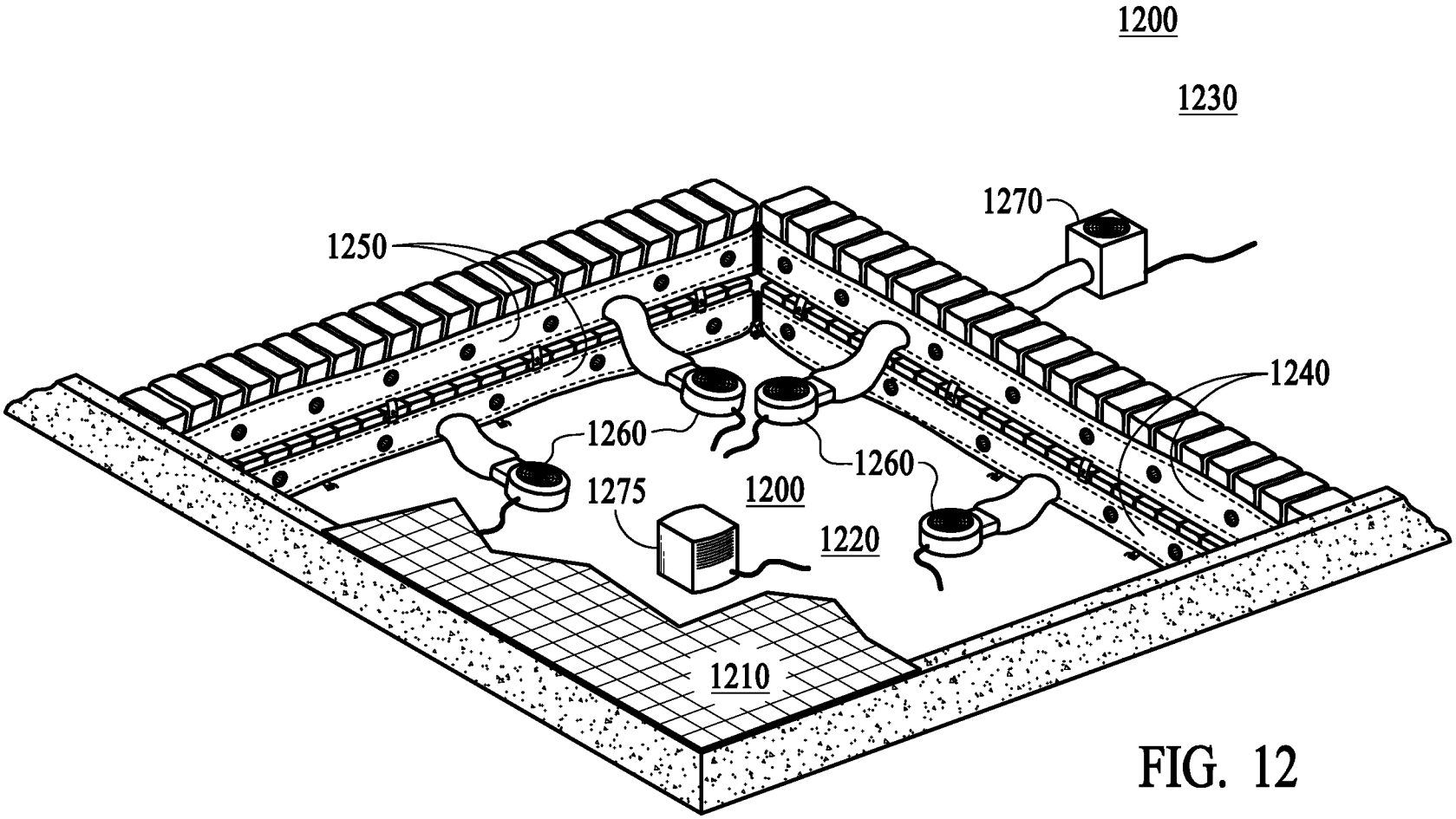
FIG. 12 illustrates an example of using several blow-dry enclosures to dry a section of a crawlspace according to an embodiment of the invention.

FIG. 12 illustrates an example of using several blow-dry enclosures to dry a section of a crawlspace 1200 according to an embodiment of the invention. Crawlspace 1200 is located below a floor 1210 and is partitioned in first section 1220 which needs to be dried, and second section 1230 which does not need to be dried. Crawlspace 1200 has one or more dehumidifiers (dehu 1275), that are located in first section 1220. A first combination 1240 of blow-dry enclosures and a second combination 1250 of blow-dry enclosures separate first section 1220 from second section 1230. Each of the individual blow-dry enclosures in first combination 1240 and second combination 1250 is connected with at least one air mover 1260, and one or more of the individual blow-dry enclosures may also be connected with a heat injector 1270. By stacking sufficient blow-dry enclosures, the height of crawlspace 1200 is fully blocked. By side-connecting sufficient blow-dry enclosures, a sufficient part of the circumference of first section 1220 is blocked off.

Heat injector 1270 takes in air from second section 1230, heats it, and injects it into one of the blow-dry enclosures. The one or more dehu 1275's dry out and also heat the air, and with dry warm air moving around first section 1220, moisture is removed efficiently.

Figure 13:
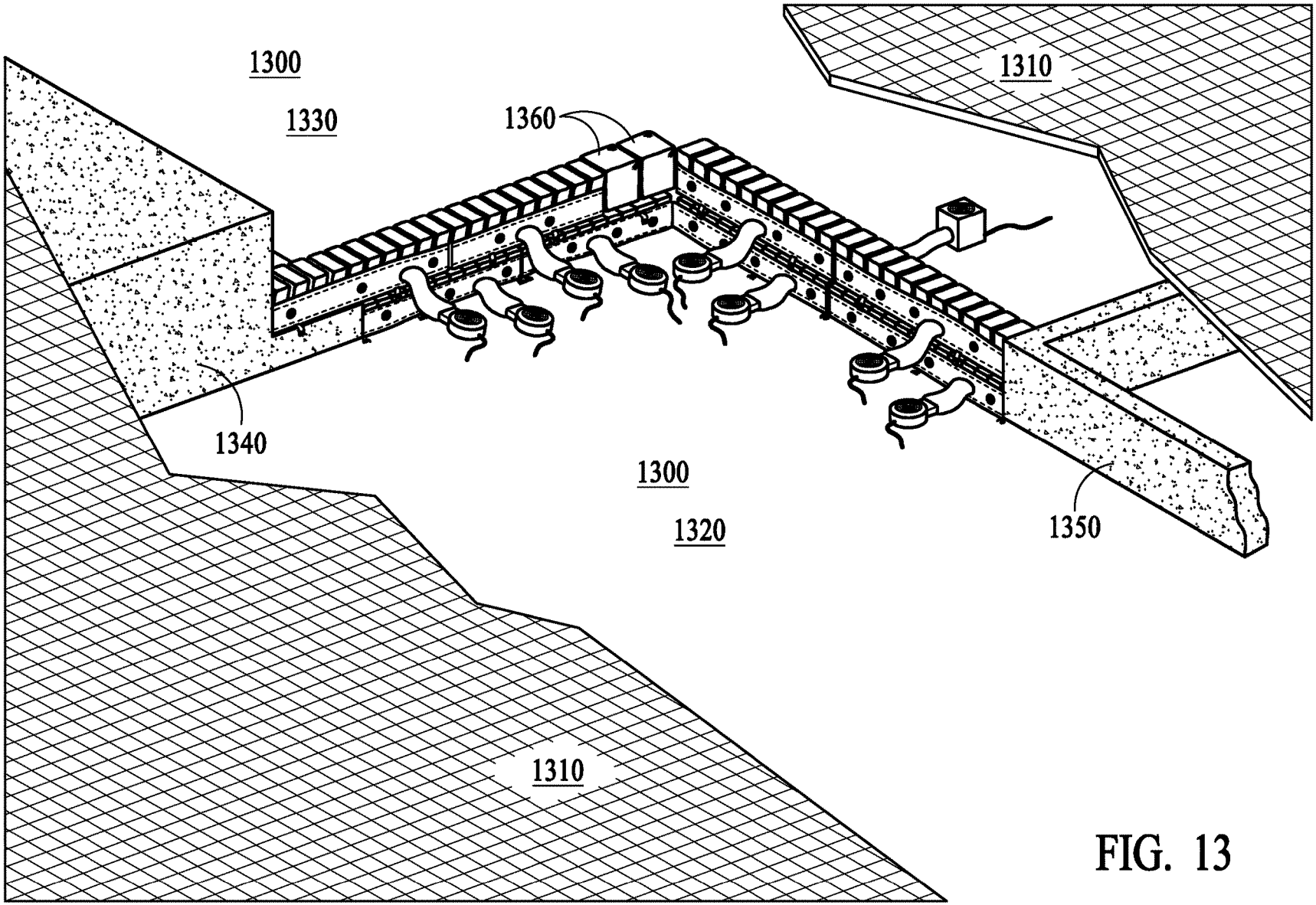
FIG. 13 illustrates another example of using several blow-dry enclosures to dry a section of a crawlspace according to an embodiment of the invention.

FIG. 13 illustrates another example of using several blow-dry enclosures to dry a section of a crawlspace 1300 according to an embodiment of the invention. Crawlspace 1300 is located below a floor 1310 and is partitioned in first section 1320 which needs to be dried, and second section 1330 which does not need to be dried. Crawlspace 1300 includes first wall 1340 and second wall 1350, which may have features such as corners and partial extensions that don't fill up the full height of crawlspace 1300. Convenient placement of air blocks 1360 allows full separation of first section 1320 from second section 1330.

Figure 14A:
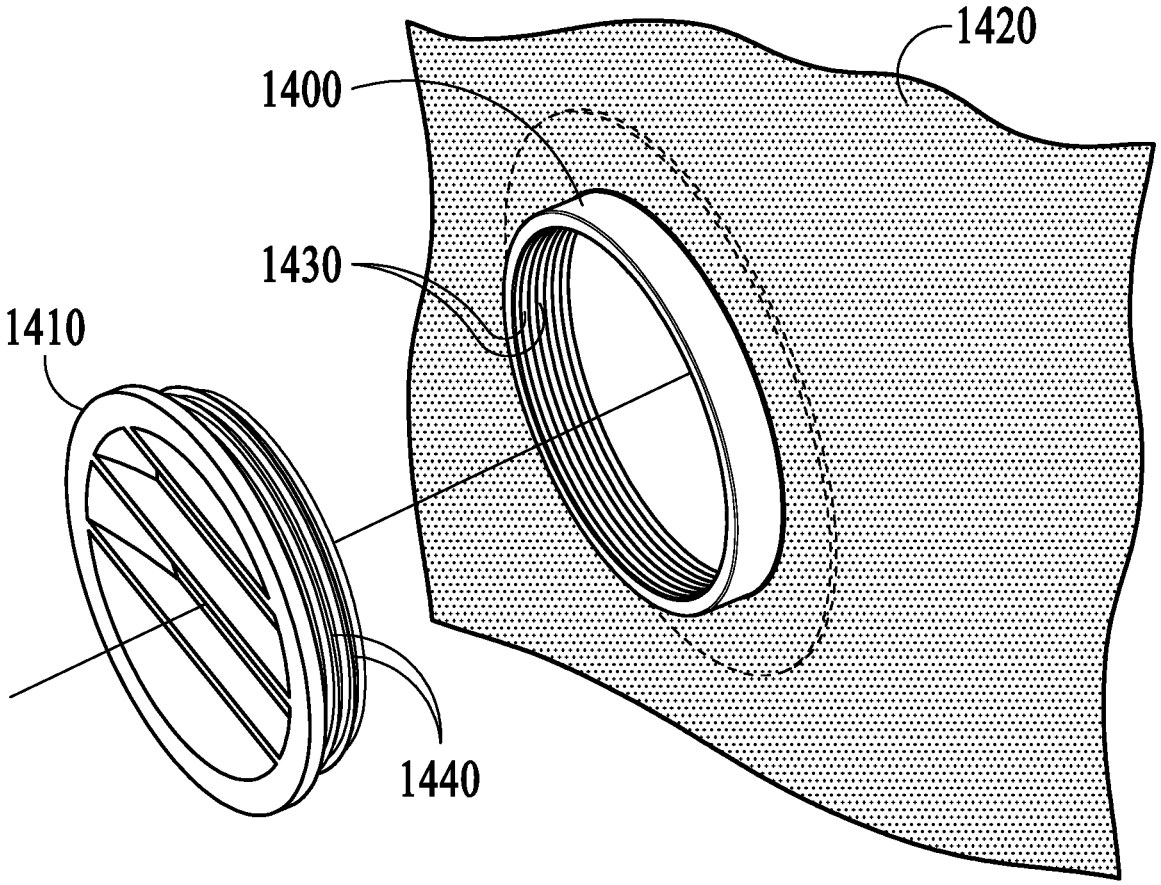
FIGS. 14A-C illustrate a vent carrier and a vent according to an embodiment of the invention.
Figure 14B:
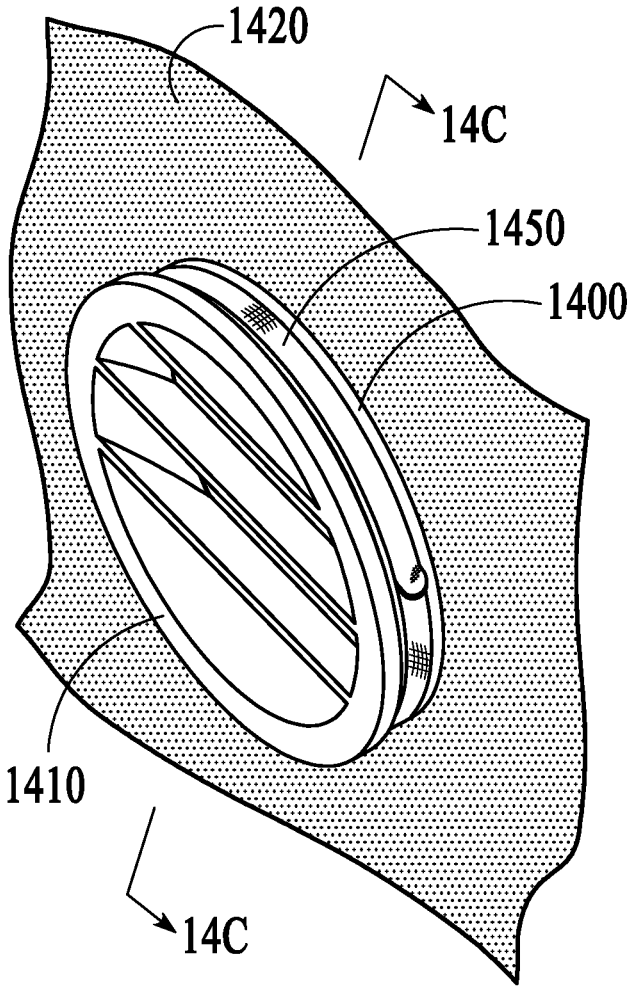
Figure 14C:
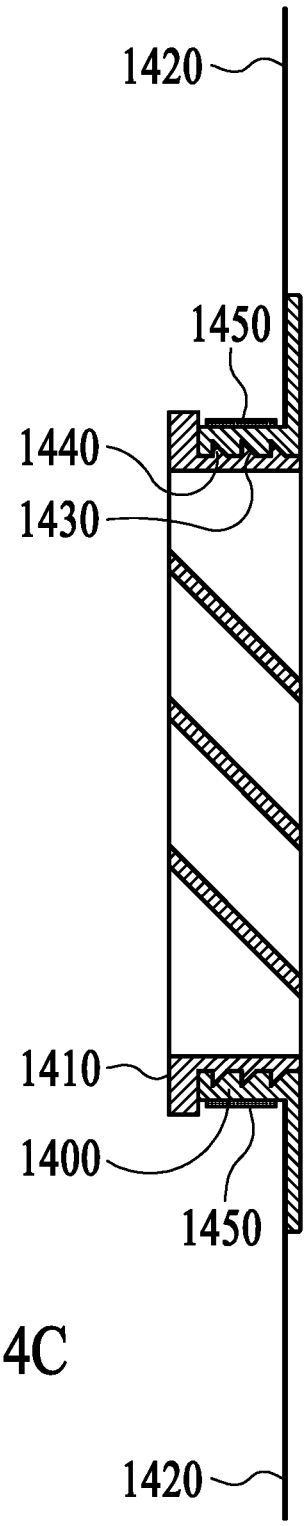

FIGS. 14A-C illustrate a vent carrier 1400 and a vent 1410 according to an embodiment of the invention. The function of vent carrier 1400 is to allow a user to connect and disconnect vent 1410 to and from blow-dry enclosure 1420 (a small part of whose fabric is shown), as well as rotate it in any desired direction. FIG. 14A shows vent 1410 and vent carrier 1400 separately. FIG. 14B shows a perspective view of vent carrier 1400 with vent 1410 inserted. FIG. 14C shows a cross-cut of FIG. 14B. With regular use, blow-dry enclosure 1420 will get dirty, and users may want to wash it, for example in a washing machine. However, in a washing machine, hard parts are undesirable, so in an embodiment, vent carrier 1400 may be made from a soft material, for example polyurethane, which may be sewn or glued to the fabric, whereas vent 1410 may be made, for example, from a hard plastic. Vent carrier 1400 fits around vent 1410, and when vent 1410 has been inserted into vent carrier 1400, it can rotate as desired. A user may firmly attach vent 1410 to vent carrier 1400 by tying a strap 1450 around vent carrier 1400, as shown in FIGS. 14B-C. Strap 1450 may be a simple rope, a tie wrap, a zip tie, or a strap with hook and loop fastener areas, such as made by Velcro, or any other strap that firmly ties vent carrier 1400 to vent 1410.

In an embodiment, vent carrier 1400 may have inside facing barbs 1430, and vent 1410 may have matching outside facing barbs 1440. The barbs will further strengthen a connection between vent carrier 1400 and vent 1410 when strap 1450 is tied around vent carrier 1400. However, the barbs leave it sufficiently easy to disconnect vent 1410 from vent carrier 1400 when no strap is tied around vent carrier 1400.

Figure 15:
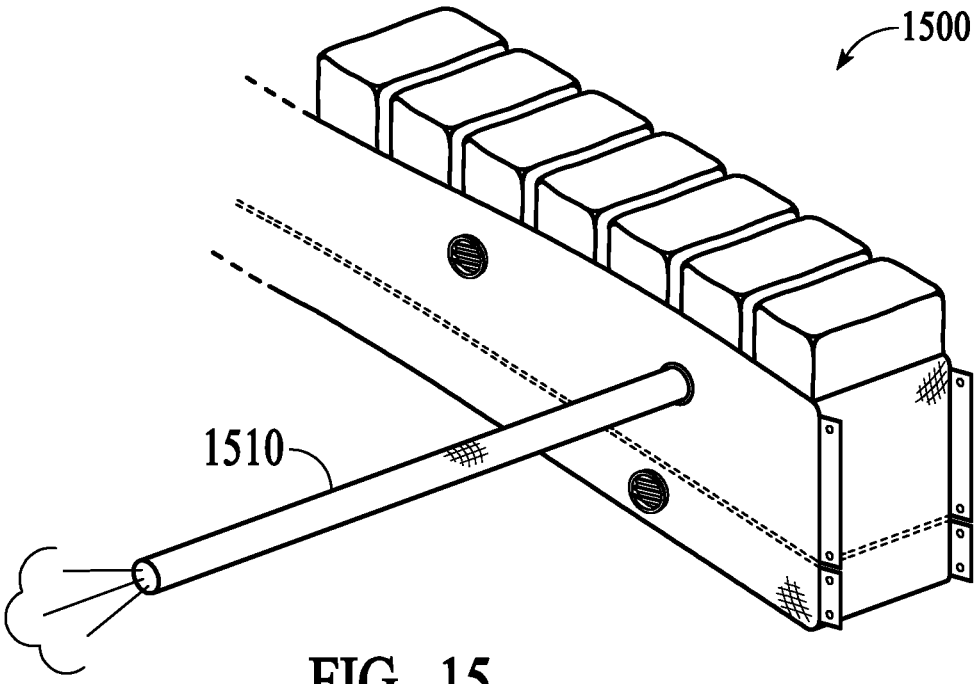
FIG. 15 illustrates an air focus hose according to an embodiment of the invention.

FIG. 15 illustrates an air focus hose 1510 according to an embodiment of the invention. An air focus hose allows a user to direct air flow at specific objects or locations that are wetter than their surroundings and that need additional air flow to dry fast enough. Air focus hose 1510 is connected to blow-dry enclosure 1500 at a vent carrier. Air focus hose 1510 may be made of a low-cost flexible plastic, such as low-density polyethylene (LDPE). In this way, a user may reuse air focus hose 1510 as needed, and recycle it when done. In other embodiments, air focus hose 1510 may be made of the same material as blow-dry enclosure 1500. In further embodiments, air focus hose 1510 may be internally reinforced with a metal or plastic spiral or other reinforcement. One manner of connecting air focus hose 1510 to blow-dry enclosure 1500 is to insert a vent into a vent carrier (both not shown), then insert the vent carrier into air focus hose 1510, and subsequently tie a strap around air focus hose 1510, the vent carrier, and the vent. During operation, blow-dry enclosure 1500 is inflated, and air escapes through the vent into air focus hose 1510. Air focus hose 1510 transports the air from its entrance at blow-dry enclosure 1500 to its exit at the other end. Since the material is flexible, a user can place the exit wherever needed, and use any convenient method to keep it in place. One basic method is to place a stone or other weight in the exit or elsewhere inside to prevent it from moving. Another method is to stick it to some surface, for example using duct tape, an adhesive, a nail, a screw, a staple, or a zip tie.

Figure 16:
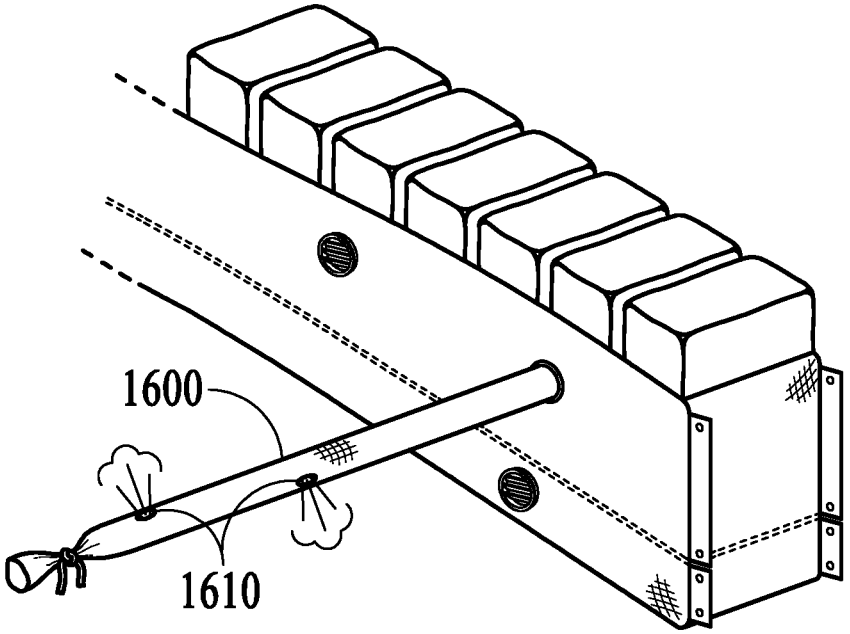
FIG. 16 illustrates usage of the air focus hose with sideway outlets according to an embodiment of the invention.

FIG. 16 illustrates usage of the air focus hose 1600 with sideway outlets 1610 according to an embodiment of the invention. Sideway outlets 1610 provide a user extra flexibility to direct the air as needed. The user ties up the end of air focus hose 1600 if no air flow is needed there, and cuts one or a few holes to form sideway outlets 1610 as needed. Again, the user can place air focus hose 1600 in any desired path by using one or more stones or other weights to weigh it down, and/or by sticking it to any convenient surface.

Figure 17:
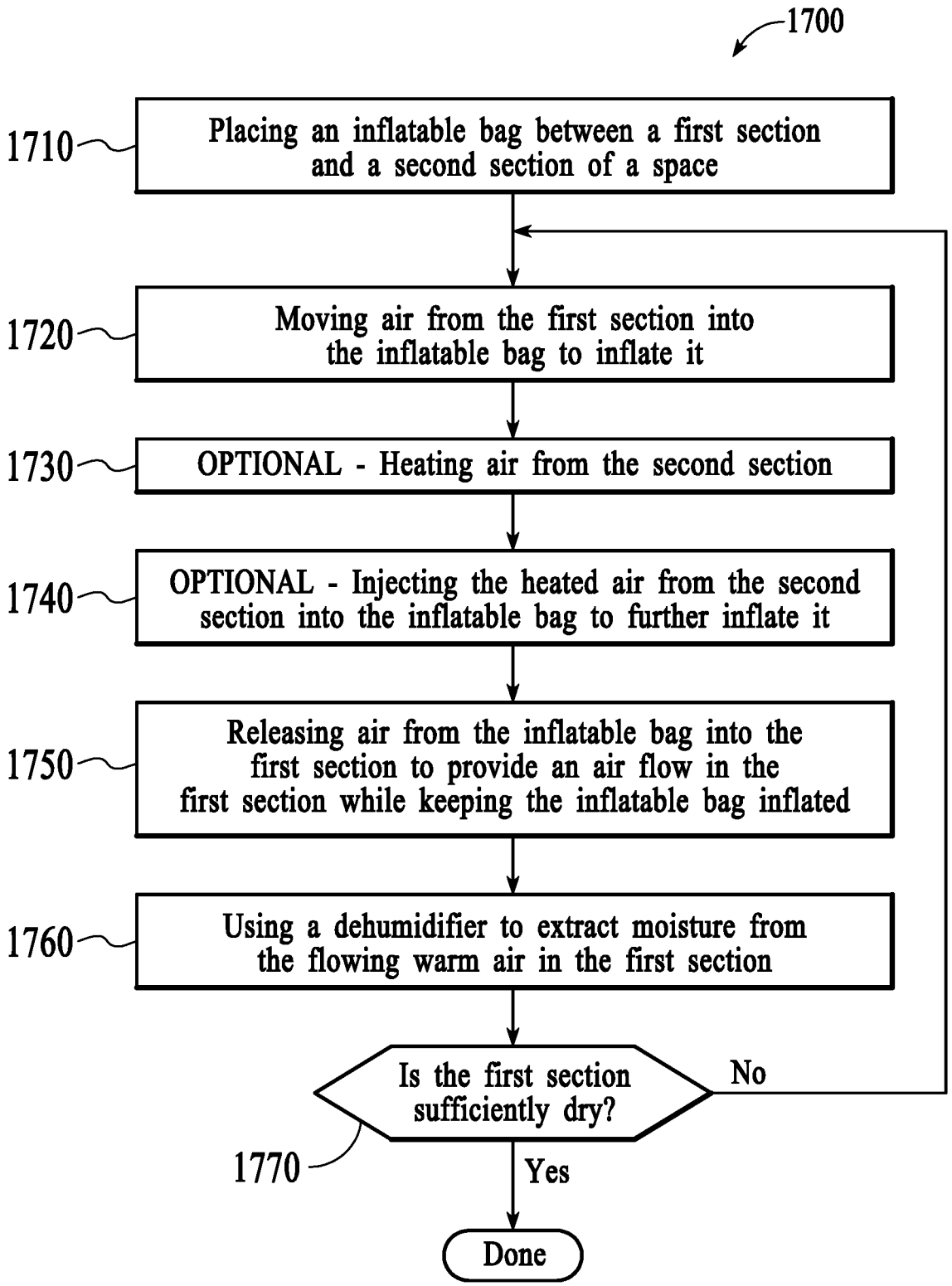
FIG. 17 illustrates a method of drying a first section of a space according to an embodiment of the invention.

FIG. 17 illustrates a method 1700 of drying a first section of a space according to an embodiment of the invention. Method 1700 comprises the following steps.

Step (a) 1710—Placing an inflatable bag between the first section and a second section of the space. The bag is placed such that, when inflated, it cordons off the first section from the second section. The first section needs to be dried. The second section may not need to be dried.

Step (b) 1720—Moving air from the first section into the inflatable bag to inflate it.

Step (c) 1730—OPTIONAL—Heating air from the second section.

Step (d) 1740—OPTIONAL—Injecting the heated air from the second section into the inflatable bag to further inflate it.

Step (e) 1750—Releasing air from the inflatable bag into the first section to provide an air flow in the first section while keeping the inflatable bag inflated. The flowing warm or hot air will absorb moisture from structures, floors, and/or ceilings in the first section.

Step (f) 1760—Using a dehumidifier or desiccant to extract moisture from the flowing warm air in the first section.

Step (g) 1770—Repeating steps 1420-1460 until the first section has reached a dry standard. The dry standard may be an industry dry standard.

Figure 18:
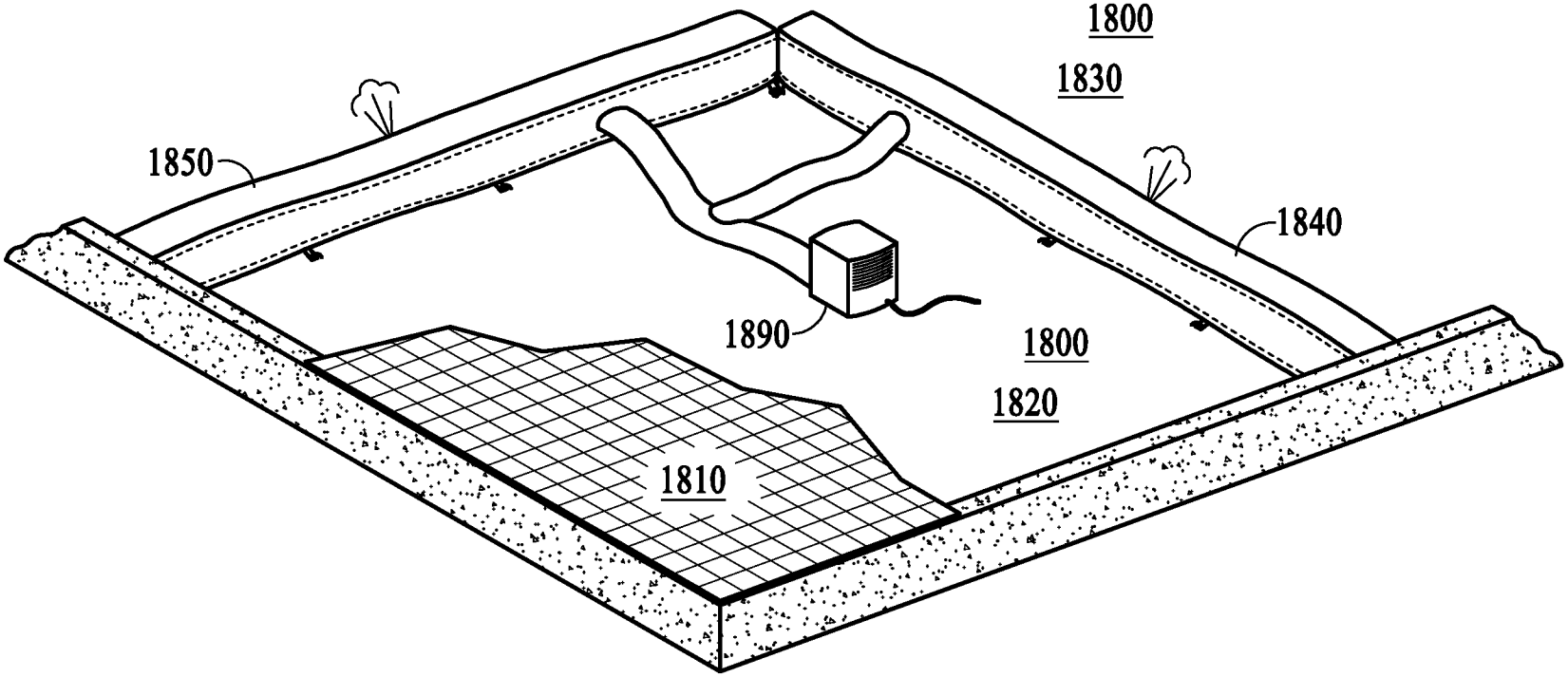
FIG. 18 illustrates an example of using blow-dry enclosures to contain mold in a section of a crawlspace according to an embodiment of the invention.

FIG. 18 illustrates an example of using blow-dry enclosures to contain mold, lead, asbestos, or other contaminants in a section of a crawlspace 1800 according to an embodiment of the invention. Crawlspace 1800 is located below floor 1810 and is partitioned in a first section 1820 which needs to be made hygienic, and second section 1830 which does not need to be treated. First section 1820 is separated from second section 1830 by (in this example) first blow-dry enclosure 1840 and second blow-dry enclosure 1850. Both are connected with filtering air mover 1890, which may include a high-efficiency particulate air (HEPA) filter, or any other filter capable of effectively removing non-hygienic particles from the air. Filtering air mover 1890 is located inside first section 1820, and filters and moves air from first section 1820 into first blow-dry enclosure 1840 and second blow-dry enclosure 1850. These inflate, and hence cordon first section 1820 off from second section 1830. Clean air may be released into second section 1830 or anywhere else. As a result of the air being taken out of first section 1820, it will have a lower air pressure than second section 1830. Clean air may seep back into first section 1820 through gaps and replace air that has been removed.

Figure 19:
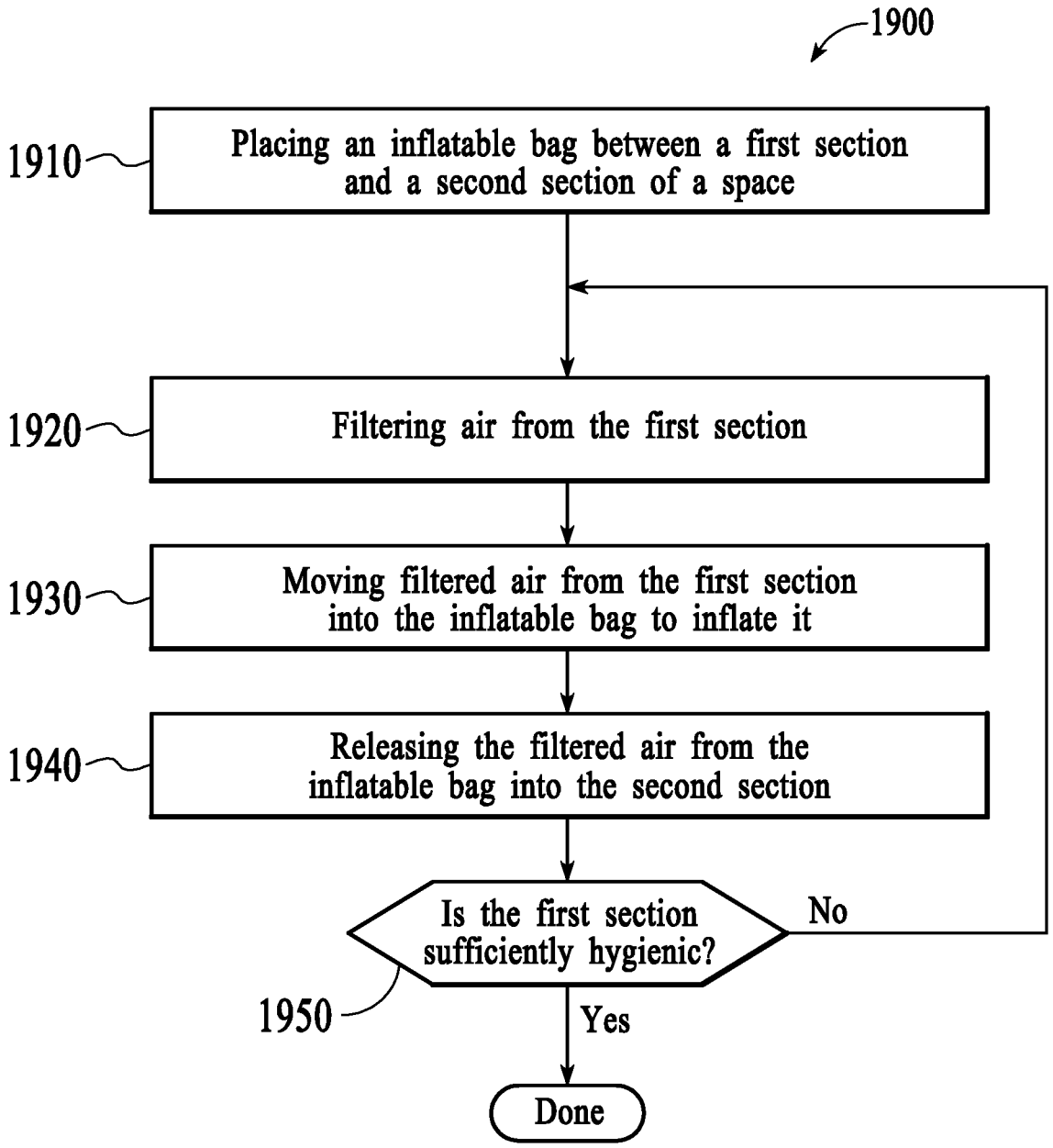
FIG. 19 illustrates a method of containing contaminants in a first section of a space according to an embodiment of the invention.

FIG. 19 illustrates a method 1900 of containing contaminants in a first section of a space according to an embodiment of the invention. A contaminant may be, for example, mold, lead, asbestos, etc. The method comprises the following steps.

Step (a) 1910—Placing an inflatable bag between a first section and a second section of a space. Embodiments place the inflatable bag such that (once inflated) it separates the first section from the second section.

Step (b) 1920—Filtering air from the first section, for example using a HEPA filter. A HEPA filter reduces the number of particles in the air, thereby making the air more hygienic. Embodiments may use any type of filter that effectively removes the contaminants from the air.

Step (c) 1930—Moving the filtered air from the first section into the inflatable bag to inflate it. This results in the separation of the first and second sections, and in a flow of contaminated air through the filter.

Step (d) 1940—Releasing the filtered air from the inflatable bag. An embodiment releases the filtered air through one or more relatively small openings, to keep the pressure in the inflatable bag high enough to keep it inflated. The embodiment may release the filtered air into the second section, or into any other convenient space.

Step (e) 1950—Determining if the first section is sufficiently hygienic by determining if the presence of contaminants in the first section is sufficiently low. Upon determining that the first section is not sufficiently hygienic, repeating steps 1920 through 1950. Upon determining that the first section is sufficiently hygienic, the method ends. In an embodiment, mold may be measured with a mold test kit such as those that are readily available in the industry. For other contaminants, embodiments use commensurate measuring equipment.

While a user may often place an inflatable bag horizontally on the floor, in some circumstances the user may decide to place the inflatable bag vertically, i.e. on one of its sides, for example to close off a door opening.

Although the description has been described with respect to particular embodiments thereof, these particular embodiments are merely illustrative, and not restrictive. For example, figures show application of the respective blow-dry enclosures in various crawlspaces. However, blow-dry enclosures can also be effectively used to dry out spaces that are not limited in height. Part of a kitchen or bathroom might have water damage in the lowest couple of feet, whereas a ceiling might be many feet away. One or more blow-dry enclosures can cordon off the circumference of the section to be dried, and a tarp could close the top of the cordoned off section. With similar variations, blow-dry enclosures can effectively be used to dry out many types of space that needs to be dried out.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

The invention claimed is:

1. A blow-dry enclosure comprising an inflatable bag with a first opening located on a first side, wherein:

the inflatable bag is generally in a shape that allows separating air in a first section of space in a building from air in a second section of space in the building and that allows providing containment of the air in the first section, wherein the first section and the second section are outside the blow-dry enclosure;

the inflatable bag is configured to keep the air in the first section at a different pressure than the air in the second section;

the inflatable bag is made of a rugged material that withstands puncturing;

the first opening is configured to receive air inflow from a first air mover;

the inflatable bag has a second side different than the first side and a third side different than the first and second sides; and a first vent carrier is located on the first side, wherein the first vent carrier is configured to contain and connect to a removable and replaceable first vent, and wherein the first vent is configured to release air from inside the inflatable bag to the first section of space while the inflatable bag stays inflated.

2. The blow-dry enclosure of claim 1, wherein the inflatable bag is generally in the shape of a block.

3. The blow-dry enclosure of claim 1, wherein the material is coated with an impermeable layer to reduce air leakage.

4. The blow-dry enclosure of claim 1, wherein the material is lightweight and machine-washable.

5. The blow-dry enclosure of claim 1, further comprising two or more inflatable towers on the second side, wherein two adjacent inflatable towers are configured to provide the blow-dry enclosure additional surface area to enable the blow-dry enclosure to accurately minimize air gaps between the blow-dry enclosure and features outside of the second side.

6. The blow-dry enclosure of claim 1 further comprising a second opening on the third side, wherein the second opening is configured to receive air inflow from a heat injector.

7. The blow-dry enclosure of claim 1 wherein the first vent carrier is made of a soft material that is machine-washable.

8. The blow-dry enclosure of claim 1 wherein the first vent carrier has inside facing barbs and the first vent has matching outside facing barbs and wherein the first vent is adjustable, such that a user can set a direction of air coming out of the first vent.

9. The blow-dry enclosure of claim 1, further comprising a first hose connected on one end to the first opening and wherein another end of the first hose is configured to be connected to the first air mover.

10. The blow-dry enclosure of claim 1, further comprising a connector configured to temporarily connect the blow-dry enclosure to a second blow-dry enclosure.

11. The blow-dry enclosure of claim 10, wherein the connector further includes at least one of a snap, a hook-and-loop fastener, or a zipper.

12. The blow-dry enclosure of claim 1, further comprising a second vent, wherein the second vent is configured to be connected to a second blow-dry enclosure via a second hose.

13. The blow-dry enclosure of claim 1, further comprising a strap on the first side or on the third side, wherein the strap is adjustable and configured to curve or shorten the blow-dry enclosure when inflated.

14. The blow-dry enclosure of claim 1, further comprising an anchor tab, configured for anchoring the blow-dry enclosure to the ground.

15. A method of drying a first section of a space, the method comprising the following steps:

(a) placing an inflatable bag between the first section and a second section of the space, wherein the first section and the second section are outside of the inflatable bag;

(b) moving air from the first section into the inflatable bag to inflate it, thereby fully physically separating the first section from the second section to cordon off the first section from the second section;

(e) releasing air from a vent in the inflatable bag into the first section to provide an air flow in the first section while keeping the inflatable bag inflated;

(f) extracting moisture from the flowing warm air in the first section; and (e) repeating steps (b)-(f) until the first section has reached a dry standard.

16. The method of claim 15, further comprising steps:

(c) heating air from the second section; and (d) injecting the heated air from the second section into the inflatable bag to further inflate it.

17. The method of claim 15, wherein the moisture is extracted by at least one of a dehumidifier or a desiccant.

18. The method of claim 15, wherein the dry standard is an industry dry standard.

* * * * *